United States Patent [19]

Bortz et al.

[11] 4,278,296

[45] Jul. 14, 1981

[54] COAL MINING DRUM WITH ADJUSTABLE LINIER EDGE CUTTERS

[75] Inventors: Karl Bortz, Bottrop; Heinrich Thesing, Gelsenkirchen-Buer; Friedrich Eichbaum, Velbert, all of Fed. Rep. of Germany

[73] Assignee: Bergwerksverband GmbH, Essen, Fed. Rep. of Germany

[21] Appl. No.: 57,379

[22] Filed: Jul. 13, 1979

[30] Foreign Application Priority Data

Jul. 15, 1978 [DE] Fed. Rep. of Germany ..... 2831197

[51] Int. Cl.[3] ..... E21C 35/18

[52] U.S. Cl. ..... 299/87; 175/382; 175/394

[58] Field of Search ..... 299/80, 87; 175/394, 175/382

[56] References Cited

U.S. PATENT DOCUMENTS

| | | | |
|---|---|---|---|
| 1,019,251 | 3/1912 | Hess | 299/87 |
| 3,085,795 | 4/1963 | Snipe et al. | 299/87 |
| 3,295,232 | 1/1967 | Oglesby et al. | 299/87 X |
| 3,343,883 | 9/1967 | Whittaker | 299/87 X |

FOREIGN PATENT DOCUMENTS

| | | | |
|---|---|---|---|
| 1138363 | 1/1969 | United Kingdom | 299/87 |

*Primary Examiner*—Ernest R. Purser

*Attorney, Agent, or Firm*—Michael J. Striker

[57] ABSTRACT

A coal winning machine with a mechanical tool has a tool body provided with one or more projecting flanges helically surrounding the axis of rotation of the tool body. Cutting tools are provided, each having a linear cutting edge, and these are removably mounted on the flange or flanges in such a manner that they can assume at least two alternative positions in each of which the cutting edge of the respective tool defines a different cutting angle.

16 Claims, 7 Drawing Figures

COAL MINING DRUM WITH ADJUSTABLE LINIER EDGE CUTTERS

BACKGROUND OF THE INVENTION

The present invention relates to a coal winning machine for use in mining operations.

More particularly, the invention relates to a coal winning machine having a cutting tool which may or may not be in form of a shearing drum. For convenience the invention will hereafter be described with reference to a machine of the type having such a shearing drum.

Coal winning machines with shearing drums are used rather widely in mining, particularly in underground mining of bituminous coal. The shearing drums rotate about an axis of rotation and are provided with cutting tools (so-called "picks") which are so mounted on the drum as to extend either radially or axially. Depending upon the particular radial or axial orientation the tools will contact the mine face (i.e. the coal and/or the rock matrix) with point contact or with line contact. These prior art arrangements suffer from the disadvantage that a very large number of cutting tools is required and that the wear of the tools is exceedingly high. In addition, and this is particularly true in the winning of bituminous coal, these arrangements produce an undesirably large amount of fines, i.e. small and smallest coal and rock particles and a concomitant evolution of dust. This is undesirable because of the danger of explosion and the health hazards which it represents (e.g. "miner's lung").

In an attempt to avoid these problems it has been proposed to provide a modified construction in which the helical flange surrounding the outer surface of the drum (and serving to guide separated pieces of coal and rock matrix away from the mine face so that they can drop upon a conveyor extending along the mine face) is provided with recesses into which mounting arrangements are welded wherein disk-shaped or plate-shaped cutting tools are turnably mounted. The mounting is such that these tools can turn about axes extending parallel to the axis of rotation of the drum, so that the tools can turn in the direction of drum advancement. With this proposal a considerably smaller number of cutting tools is required, in part because these plate-shaped tools have linear cutting edges. The wear on the cutting tools is reduced somewhat, and the down-time for repairs is decreased. Also, the undesired production of fines is substantially reduced.

Even this proposal, however, is far from satisfactory. The just-described modified equipment cannot readily be accommodated to different coal conditions (e.g. different seam thicknesses, different coal versus matrix conditions, and the like). Furthermore, the specific winning capacity of this equipment is relatively poor, primarily because none of the plate-shaped tools will cut for the subsequently following tool or tools sufficient free space, and finally the arrangement and construction of the tools themselves causes high friction in operation and thus results in wear which, although somewhat less than in the first-described types of equipment, is still far too high to be satisfactory.

SUMMARY OF THE INVENTION

Accordingly, it is a general object of this invention to overcome the disadvantages of the prior art.

More particularly, it is an object of this invention to provide an improved coal winning machine of the type in question in which friction on the cutting tools is reduced in operation, with a concomitant highly significant reduction of wear.

Still a further object of the invention is to provide such a coal winning machine which is capable of a much improved production per unit time.

A concomitant object of the invention is to provide such a machine which can be more readily accommodated to different coal conditions and reduces the amount of fines produced in operation.

In keeping with these objects, and with others which will become apparent hereafter, one feature of the invention resides, in a coal winning machine having a mechanical tool, in a combination which, briefly stated, may comprise a tool body having an axis of rotation and a surface spaced from and surrounding the axis, at least one projecting flange on the surface helically surrounding the axis lengthwise thereof, and a plurality of cutting tools each having a linear cutting edge. The combination may further comprise means mounting the cutting tools on the flange for assumption of at least two different positions relative to the flange, in each of which the cutting edge of the respective tool defines a different cutting angle.

The cutting tools are disengageable from the flange and may either be mounted for rotation for turning relative to the flange, or they may be mounted rigidly in such a way that they can be set (readjusted) with reference to the flange so as to have different cutting angles.

The flange may be the helical coal-guiding flange which is anyhow provided on shearing drums of the type in question, but it is also possible to instead provide a separate flange which forms a helix counter to the helical guide flange and on which the tools are then mounted. In the latter case, the radii of the two flanges (there could of course be more than two) are preferably identical to one another.

If in fact the tools are mounted on the flange which serves the coal-guiding function, the so-called guide helix, then it is preferable if the number of turns of the guide helix is greater than customary, for example by using two or more guide helices whose turns extend parallel to one another. it is also advantageous if the cutting tools are arranged in groups on the guide helix or helices.

A mechanical tool of a coal winning machine, which is constructed in accordance with the present invention, has a host of advantages over the prior art and meets all the requirements outlined above in the objects set forth. In particular, however, it has the advantage that it permits the ideal line or pitch of the guide helix to be maintained and makes possible the use of turnable or fixedly mounted cutting tools, overcoming the prior-art difficulties in a simple and rather inexpensive manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
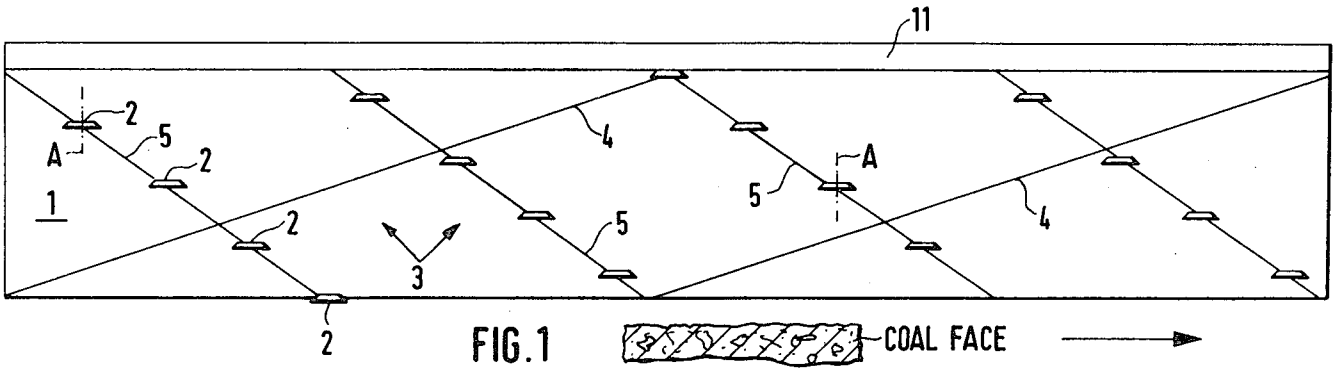
FIG. 1 is a developed view of a shear drum according to one embodiment of the invention.

A first embodiment of the invention is shown somewhat diagrammatically in FIG. 1, which is a developed view of a shear drum of a coal winning machine. The shear drum is identified with reference numeral 1 and its relative direction of rotation is indicated by the arrow beneath the figure. At one axial end the shear drum has an end ring 11 for mounting on the winning machine; its other axial end (i.e. the one facing downwardly in FIG. 1) is the one which in use faces towards the mine face from which coal is to be removed. Mounted on the circumferential surface of the drum 1 are projecting flanges 3 which may be identical in their construction. One of the flanges, identified with reference numeral 4 in FIG. 1, is the one forming the coal guiding helix whose turns helically surround the drum and extend from the front drum face (the one facing the mine face) towards the rear drum face, being inclined in the direction of drum rotation. The other flange is identified with reference numeral 5 and may, as already pointed out, be identical with the flange 4 except for the fact that its turns, which also helically surround the drum 1, are inclined in direction opposite to those of the guide helix 4, i.e. they are inclined in direction counter to the direction of drum rotation. Of course, the flanges 4 and 5 are illustrated only diagrammatically in FIG. 1, for purposes of orientation. Flanges of this type are known per se in the art and will therefore not require detailed descriptions.

In the embodiment of FIG. 1 cutting tools 2 are mounted on the flange 5, spaced from one another lengthwise of the flange. These cutting tools 2 are constructed as substantially plate-shaped or disk-shaped tools having axes of rotation A, for which purpose they are mounted on shafts secured in appropriate receivers and mounts of the flange 5. It will be noted, and this is an important feature of the invention, that each of the tools 2 produces a cut which is spaced from a similar cut (produced by the tools which follow it circumferentially as considered in the direction of rotation of the drum) in axial direction of the drum, i.e. in direction normal to the direction of rotation indicated by the arrow in FIG. 1. This means that the cut produced by each circumferentially preceding tool 2 is so closely laterally adjacent the cut to be produced by the next following tool that the structure of coal and/or matrix remaining between them is thin and weakened, making it easier for the next-following tool to provide its cut and break away the matrix material and/or coal remaining (if any) between the two cuts. Because of this, the cutting efficiency of the tool according to the present invention is greatly improved.

The outer radius of the flange 5 may be equal to the outer radius of the flange 4, or else it may be greater than the outer radius of the flange 4 in which case the turns of the flange 5 would straddle the turns of the flange 4 where they intersect the latter. Evidently, the number of turns for the flange 4 and/or the flange 5 may be selected at will, i.e. there may be as many or as few as is considered desirable.

Figure 2:
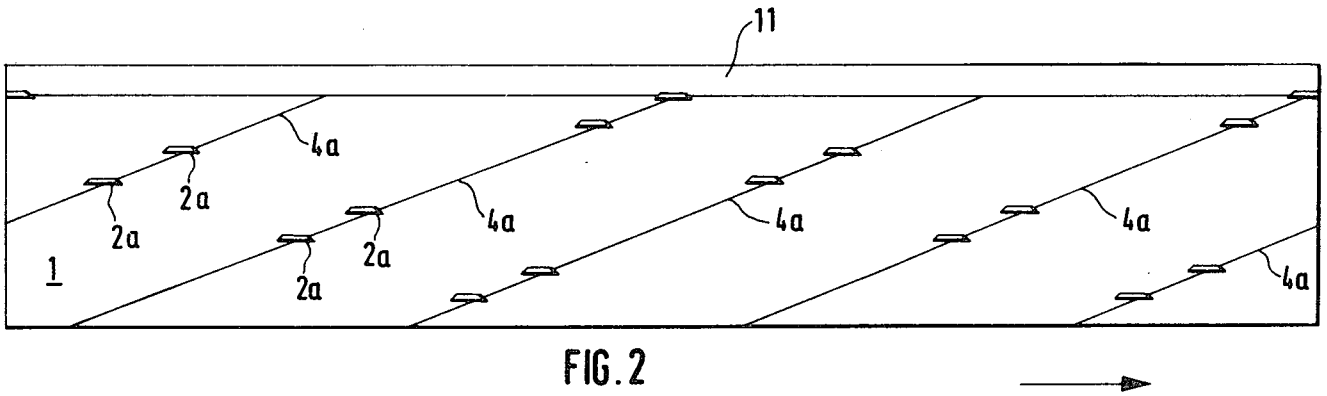
FIG. 2 is a developed view of a shear drum according to another embodiment of the invention.

The developed view of FIG. 2 illustrates another drum 1 having the end ring 11. The embodiment in FIG. 2 differs from that of FIG. 1 in that the separate flange 5 is omitted and only a flange 4*a* is provided, having, however, a larger number of turns than the flange 4 in FIG. 1, which can also be stated by saying that there may be two flanges 4*a* whose turns extend parallel to one another. The tools 2*a* are in this embodiment mounted on the flanges 4*a* and it will be noted that they are arranged in pairs (they could also be arranged in groups), which has the particular advantage that the tool which is preceding in the direction of rotation (see the arrow) will make a cut close to or perhaps even overlapping with the cut of the tool which follows it. This facilitates the cutting efficiency of the arrangement. As mentioned before, the tools 2 or 2*a* could be arranged not only in pairs, but also in groups, for example three or four per group.

Figure 3:
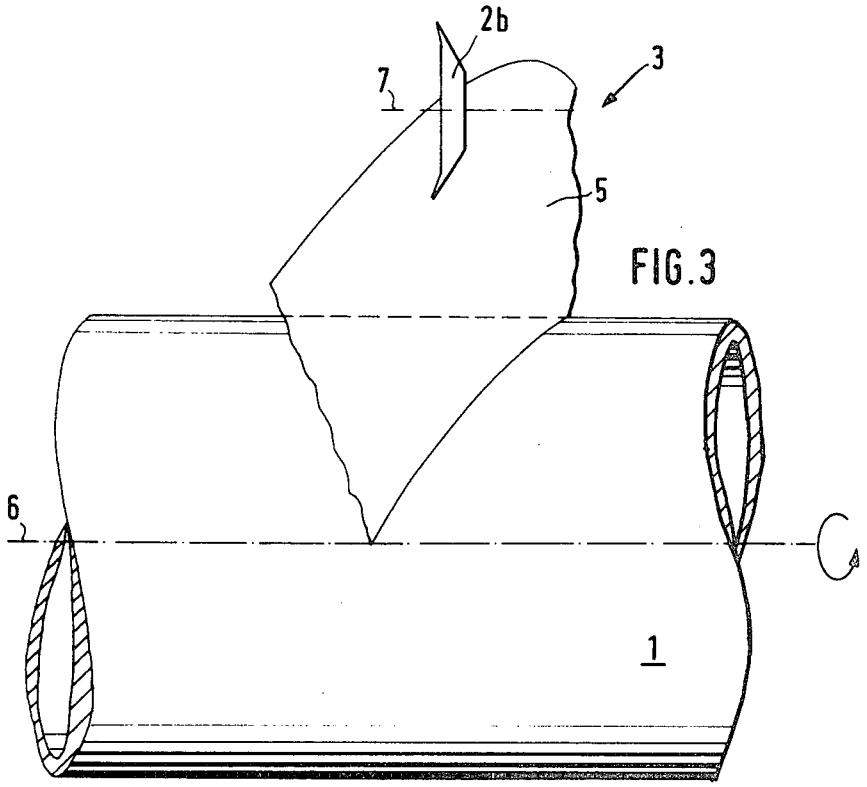
FIG. 3 is a fragmentary, partly sectioned detail view showing a detail of an embodiment of the invention.
Figure 3A:
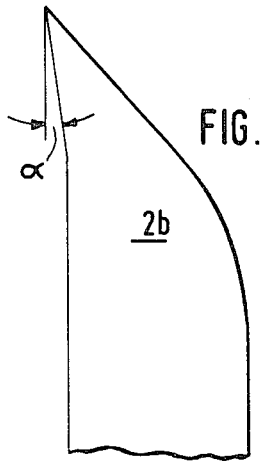
FIG. 3*a* is a fragmentary enlarged-scale detail of FIG. 3.

FIG. 3 shows a portion of the drum 1 which is rotatable (see the curved arrow) about the axis 6. Only a part of a flange 5 is visible, but it should be understood that this is representative also of the flanges 4 which are constructed and mounted similarly and on which, as shown in FIG. 2, the tools themselves may be mounted. In FIG. 3, however, the tool 2*b* (which is of disk-shaped configuration having the cross section illustrated) is mounted on a shaft (not illustrated) which is secured in the flange 5 and defines an axis of rotation 7 for the tool 2*b*. It will be noted that the arrangement is such that the tool 2*b* is mounted in cantilever fashion; i.e. the shaft is mounted only on one end in the flange 5. It will also be noted that the axis 7 extends parallel to the axis 6. FIG. 3*a* shows an enlarged detail of the tool 2*b* in FIG. 3, from which it will be seen that the tool is so shaped as to define at the side facing towards the coal face (to the left of the tool 2*b* in FIG. 3*a*) a clearance angle $\alpha$.

Figure 4:
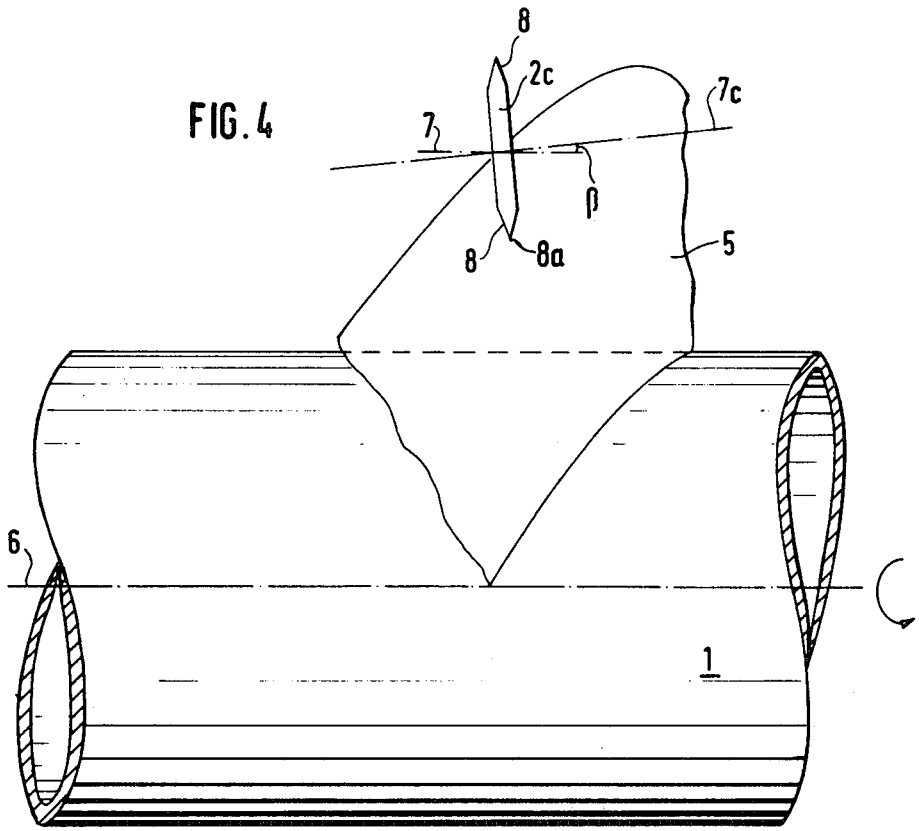
FIG. 4 is a view similar to FIG. 3 but showing another embodiment of the invention.

Such a clearance angle can also be obtained by a different configuration of the tool, such as is shown for the tool 2*c* in FIG. 4. In this embodiment, wherein like reference numerals identify like elements, the tool is again disk-shaped but its two major surfaces taper towards the periphery 8*a* in the circumferential marginal zone 8, as illustrated in the cross sectional view of the tool 2*c* in FIG. 4. The taper may be symmetrical or non-symmetrical from the center (the axis of rotation of the tool 2*c*) to the outer radius (the cutting edge 8*a*). This construction is particularly advantageous with respect to obtaining a significant reduction in wear of the tool.

To obtain a clearance angle corresponding to the angle $\alpha$ in FIG. 3*a*, the tool 2*c* in FIG. 4 is mounted for rotation, not about an axis 7 parallel to the axis 6 as in FIG. 3 (in FIG. 4 the axis 7 is shown for comparison), but instead for rotation about an axis 7*c* which is inclined to the axis 6 at an angle $\beta$. The shaft (not shown) defining the axis 7*c* may again be mounted in cantilever fashion on the flange 5. In this embodiment, as indeed in all other embodiments disclosed herein, it is intended to mount the tools not rigidly on the flanges 4 or 5, but instead to mount them detachably. In other words, instead of e.g. rigidly mounting the tools on the flanges 4 or 5 by e.g. welding, they are mounted so that they can be released, being held in place by e.g. bolts or the like. The angled position of the tools 2*c* in FIG. 4 (there will of course be more than the one that has been illustrated for purposes of explanation) allows the tools 2c to exert upon the coal and/or matrix material a breaking or splitting-loose effect which is particularly advantageous in certain types of coal seams, i.e. seams having a particular type of structure.

Figure 5:
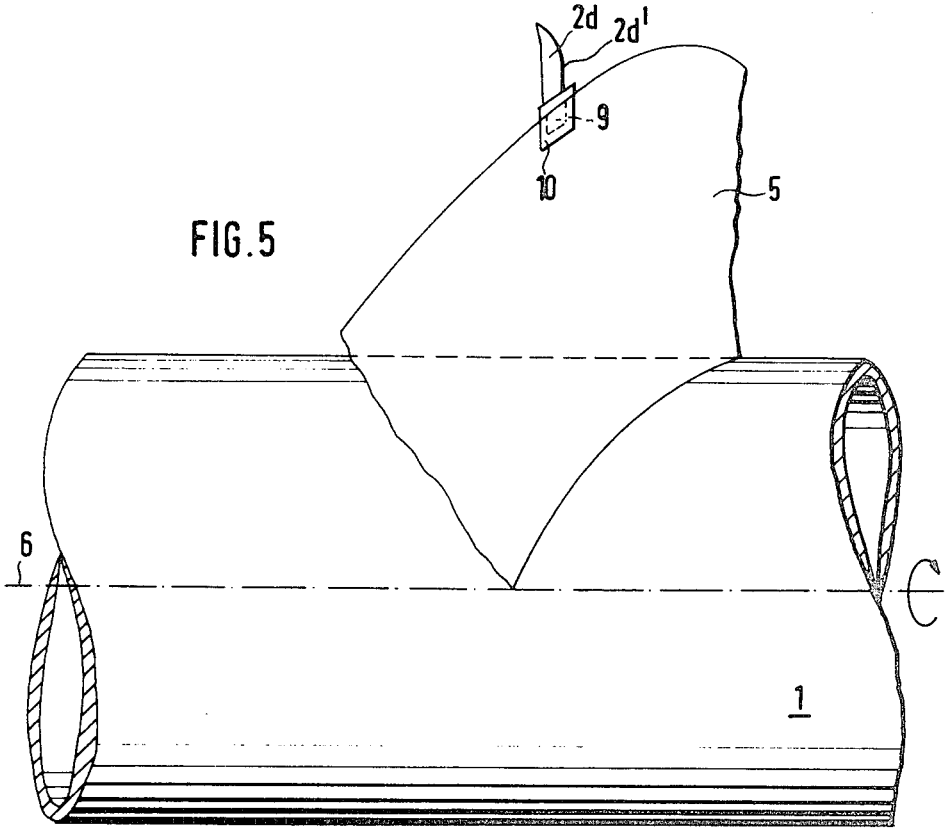
FIG. 5 also is a view similar to that in FIG. 3, showing still a further embodiment of the invention.

The cutting tools need not necessarily be mounted so as to be turnable with reference to the flanges 4 or 5. FIG. 5 shows an embodiment in which the cutting tools 2d (only one shown) are rigidly (but still detachably) mounted on the flange 5 (or the flange 4, if this is preferred). For this purpose the cutting tool 2d, which in the illustrated embodiment has the shape of a quarter of a circle and is provided with a cutting edge 2d', has an extension 9 which is of polygonal cross section and extends into a socket or receiver 10 having a similarly polygonal cross section, being mounted therein in suitable manner, e.g. by means of bolts or the like. The shape of the outer tip of the tool 2d again provides for the clearance angle $\alpha$ illustrated in FIG. 3a. The life of such a tool can be increased by periodically removing the tool from the socket and reinserting it in a different angular position, a possibility which occurs because of the mating cross sectional polygonal configuration of the extension 9 and the socket 10. The number of different angular positions possible depends, of course, upon the particular polygonal cross section chosen.

Figure 6:
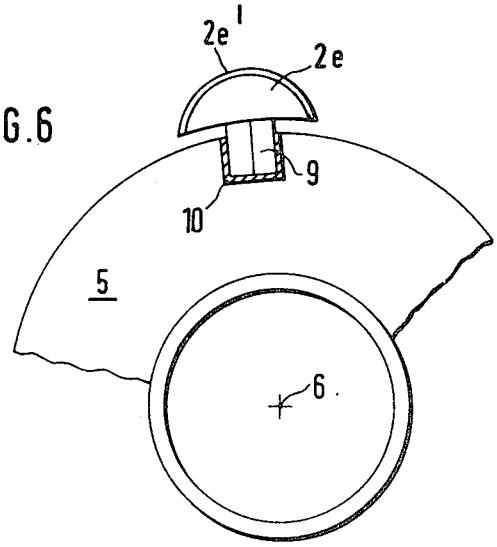
FIG. 6 is a fragmentary, partly sectioned detail view of still an additional embodiment of the invention.

The embodiment in FIG. 6 is similar to the one in FIG. 5 and like reference numerals again identify like elements. The difference here is that the cutting tool 2e has the shape of half a circle, i.e. it resembles a semi-circular sector of about 180° and has a cutting edge 2e' extending along its periphery. Extension 9 and socket 10 are again of polygonal cross section to permit insertion of the extension 9 into the socket 10 in two or more different angular positions. One of the advantages of the embodiment in FIG. 6 is that the extension 9 and the socket 10 are overlapped and in effect covered and protected by the tool 2e itself and are therefore protected against rapid wear since they do not come in contact with the coal and/or matrix material, or at least do not come in contact with them nearly as much as if they were not so protected.

It will be appreciated that the shape of the tools need not be circular (i.e. disk-like) but may also be different, for example as shown in FIGS. 5 and 6 or essentially sawtooth-like or even almost rectangular or quadratic. If the tools are disk-shaped they need not be turnable but could be mounted in the manner explained with reference to the tools shown in FIGS. 5 and 6.

It is self-evident that the invention is not limited to the use with a rotary shearer drum, but could also be used in connection with other coal winning machines, for example in connection with coal augers or coal hobs. In the latter type of machine it is presently common to use rigid picks and these could be replaced with tools according to the present invention having linear cutting edges. If the coal seam is fairly readily susceptible to material removal, the tools according to the invention would probably be sufficient by themselves without requiring additional picks. However, it would be possible to use additional picks operating upon the roof and/or the sole, and in this case these picks may be so constructed as to exert upon the hob a pulling action, drawing it towards the coal face (mine face) so as to thereby increase the force of penetration of the tools according to the invention.

While the invention has been illustrated and described as embodied in a shearer-type coal winning machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a coal winning machine having a mechanical tool, a combination comprising a tool body having a first axis about which it rotates and a surface spaced from and surrounding said first axis; at least one projecting flange on said surface helically surrounding said first axis lengthwise thereof; a plurality of cutting tools each having a linear cutting edge and a second axis; and means mounting said cutting tools on said flange for assumption of the respective second axis of at least two different positions relative to said first axis, in each of which positions the linear cutting edge of the respective tool defines a different cutting angle with said first axis.

2. A combination as defined in claim 1, said tool body having one end adapted to face towards the mine face and another end adapted to face away therefrom; and wherein said flange has a plurality of turns each inclined from said one end towards said other end in direction counter to the direction of rotation of said tool body.

3. A combination as defined in claim 1, said tool body having one end adapted to face towards the mine face and another end adapted to face away therefrom; and wherein said flange has a plurality of turns each inclined from said one end towards said other end in the direction of rotation of said tool body.

4. A combination as defined in claim 1, said tool body having one end adapted to face towards the mine face and another end adapted to face away therefrom, and wherein said flange has a plurality of turns each inclined from said one end towards said other end in direction counter to the direction of rotation of said tool body; and further comprising at least one additional projecting flange on said surface helically surrounding said first axis and having a plurality of turns each inclined from said one end towards said other end in the direction of rotation of said tool body.

5. A combination as defined in claim 4, wherein said flanges have identical radii.

6. A combination as defined in claim 4, wherein said additional flange has a radius greater than that of said at least one flange, and wherein turns of said additional flange intersect and straddle respective turns of said at least one flange.

7. A combination as defined in claim 1; and further comprising at least one other projecting flange on said surface helically surrounding said axis and having a plurality of turns located intermediate and extending substantially parallel to respective turns of said at least one flange, some of said cutting tools being mounted on said other flange.

8. A combination as defined in claim 1, wherein said tools are arranged in respective groups.

9. A combination as defined in claim 1, wherein said means comprises shafts mounting said cutting tools turnably about said second axes.

10. A combination as defined in claim 9, said cutting tools being of disk-shaped configuration.

11. A combination as defined in claim 10, said cutting tools each having a surface facing towards the coal face to be cut and having a front clearance angle.

12. A combination as defined in claim 1, wherein said cutting means comprises shafts mounting said cutting tools turnably about said second axes, said cutting tools being disk-shaped and each having two axial end faces which taper towards one another at the periphery of the respective tool, said cutting edge being formed by said periphery.

13. A combination as defined in claim 12, wherein the taper of said two axial end faces from the center of the respective tool to said periphery thereof, is symmetrical.

14. A combination as defined in claim 12, wherein the taper of said two axial end faces from the center of the respective tool to said periphery thereof, is non-symmetrical.

15. A combination as defined in claim 1, said tools each having an extension; and said means comprising respective receivers in said flange and each adapted to receive one of said extensions.

16. A combination as defined in claim 15, said extensions and said receivers each being of mating polygonal cross-section, so that each tool can be inserted into a respective receiver in a plurality of positions in each of which it is angularly offset with reference to the other positions.

* * * * *